US007131894B1

(12) United States Patent
Liao

(10) Patent No.: US 7,131,894 B1
(45) Date of Patent: Nov. 7, 2006

(54) GRINDING MACHINE WITH A DUST COLLECTING DEVICE

(76) Inventor: Chih-Ming Liao, No. 396, Yung-Ming St., Ta-Li City Taichung Hsien (TW)

( * ) Notice: Subject to any disclaimer, the term of this patent is extended or adjusted under 35 U.S.C. 154(b) by 0 days.

(21) Appl. No.: 11/331,500

(22) Filed: Jan. 12, 2006

(30) Foreign Application Priority Data

Jul. 29, 2005 (TW) ..... 94212938 U

(51) Int. Cl.
*B24B 7/00* (2006.01)

(52) U.S. Cl. ..... 451/65; 451/296; 451/456

(58) Field of Classification Search ..... 451/65, 451/296, 297, 299, 336, 337, 451, 453, 456
See application file for complete search history.

(56) References Cited

U.S. PATENT DOCUMENTS 5,199,220 A * 4/1993 Steiner et al. ..... 451/65
5,231,801 A * 8/1993 Svetlik et al. ..... 451/456
5,237,781 A 8/1993 Demetrius
6,699,108 B1 * 3/2004 Chiang ..... 451/87
6,749,492 B1 * 6/2004 Chiang ..... 451/296
2004/0092214 A1 5/2004 Chiang

* cited by examiner

*Primary Examiner*—Dung Van Nguyen
(74) *Attorney, Agent, or Firm*—Townsend and Townsend and Crew LLP

(57) ABSTRACT

A grinding machine includes an abrasive element rotatably mounted on a support frame and coupled to a drive, a blower casing including a surrounding wall which confines a blower chamber and which extends beyond and which is spaced apart radially from a rim of the abrasive element to define a surrounding intake passage therebetween, a dust discharge port disposed downstream of the intake passage, communicated with the blower chamber and, and offset from an axis of the abrasive element, and an impeller disposed in the blower chamber and coaxial with the abrasive element such that dust generated as a result of a grinding operation of the abrasive element is entrained in an air stream drawn into the blower chamber through the surrounding intake passage and subsequently out of the discharge port by virtue of rotation of the impeller.

5 Claims, 6 Drawing Sheets

GRINDING MACHINE WITH A DUST COLLECTING DEVICE

CROSS-REFERENCE TO RELATED APPLICATION

This application claims priority of Taiwanese Application No. 094212938, filed on Jul. 29, 2005.

BACKGROUND OF THE INVENTION

1. Field of the Invention

This invention relates to a grinding machine, more particularly to a grinding machine with a dust collecting device which has an impeller coaxially coupled with a grinding wheel for drawing dust into a blower chamber.

2. Description of the Related Art

Many conventional multi-function grinding machines have a variety of grinding mechanisms, such as a grinding wheel, a sanding member and a cylindrical emery-coated wheel, mounted on a support frame to meet the operator's different requirements. Since a large amount of dust is generated and scattered during the grinding or sanding operation, collecting means is needed to collect the dust. However, for the aforesaid multi-function grinding machines, at least two collecting devices are required, thereby rendering the machines bulky and structurally complicated.

SUMMARY OF THE INVENTION

The object of the present invention is to provide a grinding machine which has a dust collecting device for use with a variety of grinding mechanisms.

According to this invention, the grinding machine includes a drive mounted to a support frame to permit an output shaft thereof to deliver a drive force, a grinding wheel, a blower casing, a dust discharge port, and an impeller. The grinding wheel is rotatably mounted on the support frame and is coupled to the drive to be driven by the drive force so as to rotate about an axis in a longitudinal direction. The grinding wheel has a major wall which extends outwardly and in radial directions relative to the axis to terminate at a rim so as to form a grinding surface thereon. The blower casing includes a proximate wall with a periphery, which is disposed on the support frame and which is opposite to the major wall of the grinding wheel in the longitudinal direction, and a surrounding wall which extends from the periphery of the proximate wall in the longitudinal direction to confine a blower chamber and which extends beyond the rim of the grinding wheel to terminate at an outer surrounding edge such that the surrounding wall is spaced radially apart from the rim to define a surrounding intake passage therebetween. The dust discharge port is disposed downstream of the intake passage to be communicated with the blower chamber, and is offset from the axis. An impeller is disposed in the blower chamber and is coaxial with the grinding wheel to be rotatable about the axis such that dust generated as a result of a grinding operation of the grinding wheel is entrained in an air stream drawn into the blower chamber through the surrounding intake passage and subsequently out of the discharge port by virtue of rotation of the impeller.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
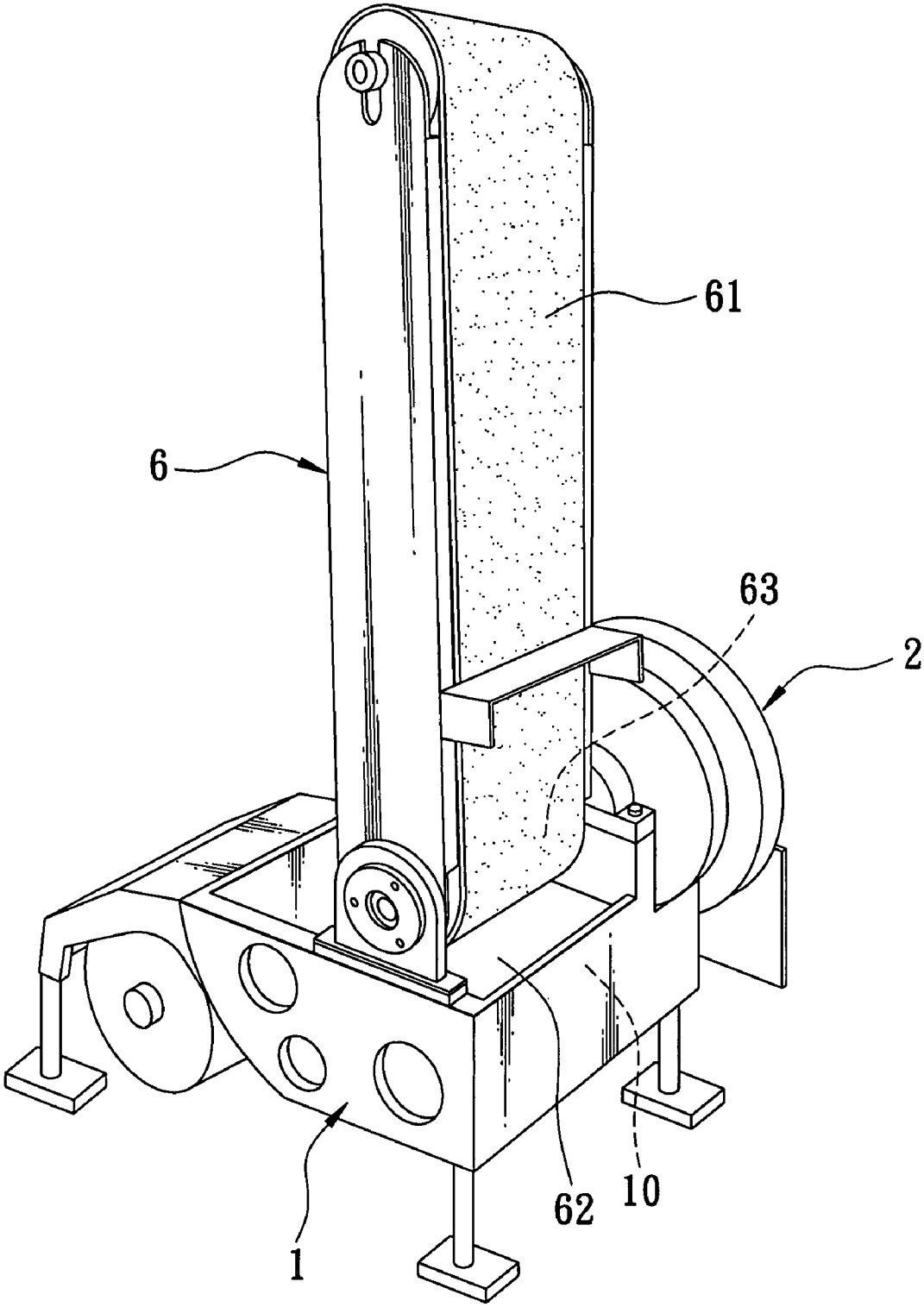
FIG. 1 is a perspective view of the preferred embodiment of a grinding machine according to this invention.
Figure 2:
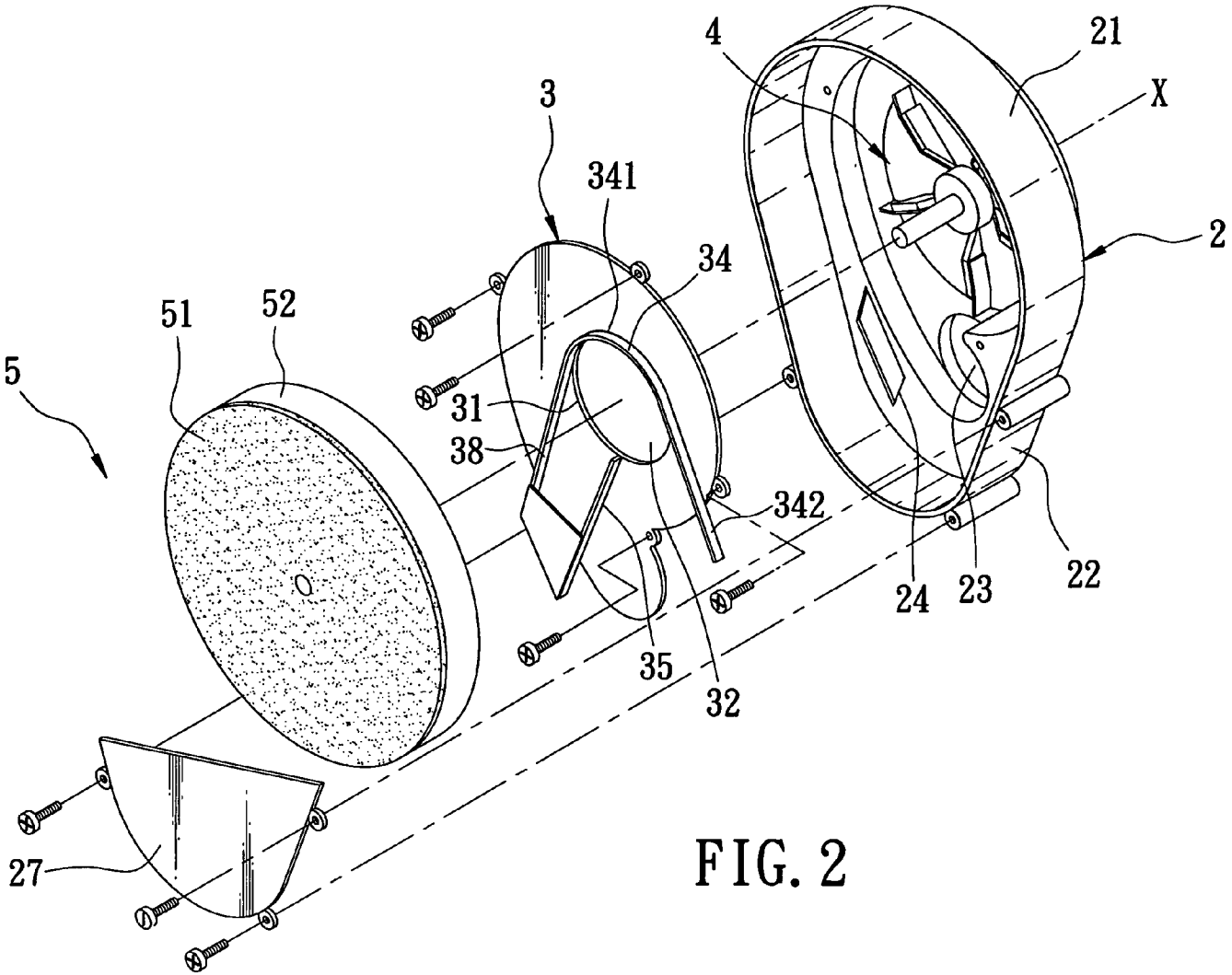
FIG. 2 is an exploded perspective view of a grinding wheel and a dust collecting device of the preferred embodiment.

Referring to FIGS. 1 and 2, the preferred embodiment of a grinding machine according to the present invention is shown to comprise a support frame 1 in the form of a machine box, a drive indicated at 10, such as a motor with an output shaft, which is mounted in the support frame 1 so as to permit the output shaft to deliver a drive force, an abrasive element such as a grinding wheel 5, a sanding member 6, and a dust collecting device 2.

The grinding wheel 5 is rotatably mounted on the support frame 1, and is coupled to the drive 10 to be driven by the drive force of the drive 10 so as to rotate about an axis (X) in a longitudinal direction. The grinding wheel 5 has a major wall 51 which extends outwardly and in radial directions relative to the axis (X) to terminate at a rim 52 so as to form an abrasive or grinding surface thereon. A work table 54 (see FIG. 6) is mounted out board to the grinding wheel 5 for supporting a workpiece (not shown).

The sanding member 6 is disposed on the support frame 1 and opposite to the grinding wheel 5 in the longitudinal direction, and has a driven wheel 63 which is coaxial with the grinding wheel 5 to be rotatable about the axis (X), and an emery coated belt 61 which is trained on and which is driven by the driven wheel 63 in a known manner for sanding a workpiece. In order to collect dust generated as a result of a sanding action of the emery coated belt 61, the support frame 1 defines a sanding dust collecting chamber 62 disposed in the vicinity of the driven wheel 63 to collect dust generated as a result of the sanding action, and a communicating port 24 (see FIG. 6) which is communicated with the sanding dust collecting chamber 62.

Referring to FIGS. 2 to 5, the dust collecting device 2 has a blower casing 21 and an impeller 4. The blower casing 21 includes a proximate wall 20 with a periphery, which is disposed on the support frame 1 and which is opposite to the major wall 51 of the grinding wheel 5 in the longitudinal direction, and a surrounding wall 22 which extends from the periphery of the proximate wall 20 in the longitudinal direction to confine a blower chamber 25 and which extends beyond the rim 52 of the grinding wheel 5 to terminate at an outer surrounding edge 211 such that the surrounding wall 22 is spaced radially apart from the rim 52 to define a surrounding intake passage 26 therebetween. A dust discharge port 23 is formed in and extends through a lower portion of the proximate wall 20 in the longitudinal direction to be communicated with the blower chamber 25. The discharge port 23 is disposed downstream of the intake passage 26, and is offset from the axis (X). A barrier plate 27 is disposed on and extends from a lower portion of the outer surrounding edge 211 to check the dust that is sent flying as a result of the grinding action of the grinding wheel 5 so as to protect the operator.

The blower casing 21 further includes a partition wall 3 which is disposed upstream of the dust discharge port 23 and downstream of the intake passage 26 so as to divide the blower chamber 25 into an impeller-side space 251 and a grinding wheel-side space 252. The partition wall 3 has an inner peripheral edge 31 which defines an air duct 32 therein and which surrounds the axis (X).

The impeller 4 is disposed in the impeller-side space 251, and is coaxial with the grinding wheel 5 to be rotatable about the axis (X). Thus, by virtue of rotation of the impeller 4, dust generated as a result of the grinding operation of the grinding wheel 5 is entrained in an air stream drawn through the intake passage 26 into the blower chamber 25, and is subsequently guided into the impeller-side space 251 through the air duct 32 for discharge through the discharge port 23.

It is noted that the impeller-side space 251 is configured to be larger under the impeller 4 and smaller above the impeller 4, and that the dust discharge port 23 is disposed below the impeller 4 so as to facilitate discharge of dust through the dust discharge port 23.

Figure 5:
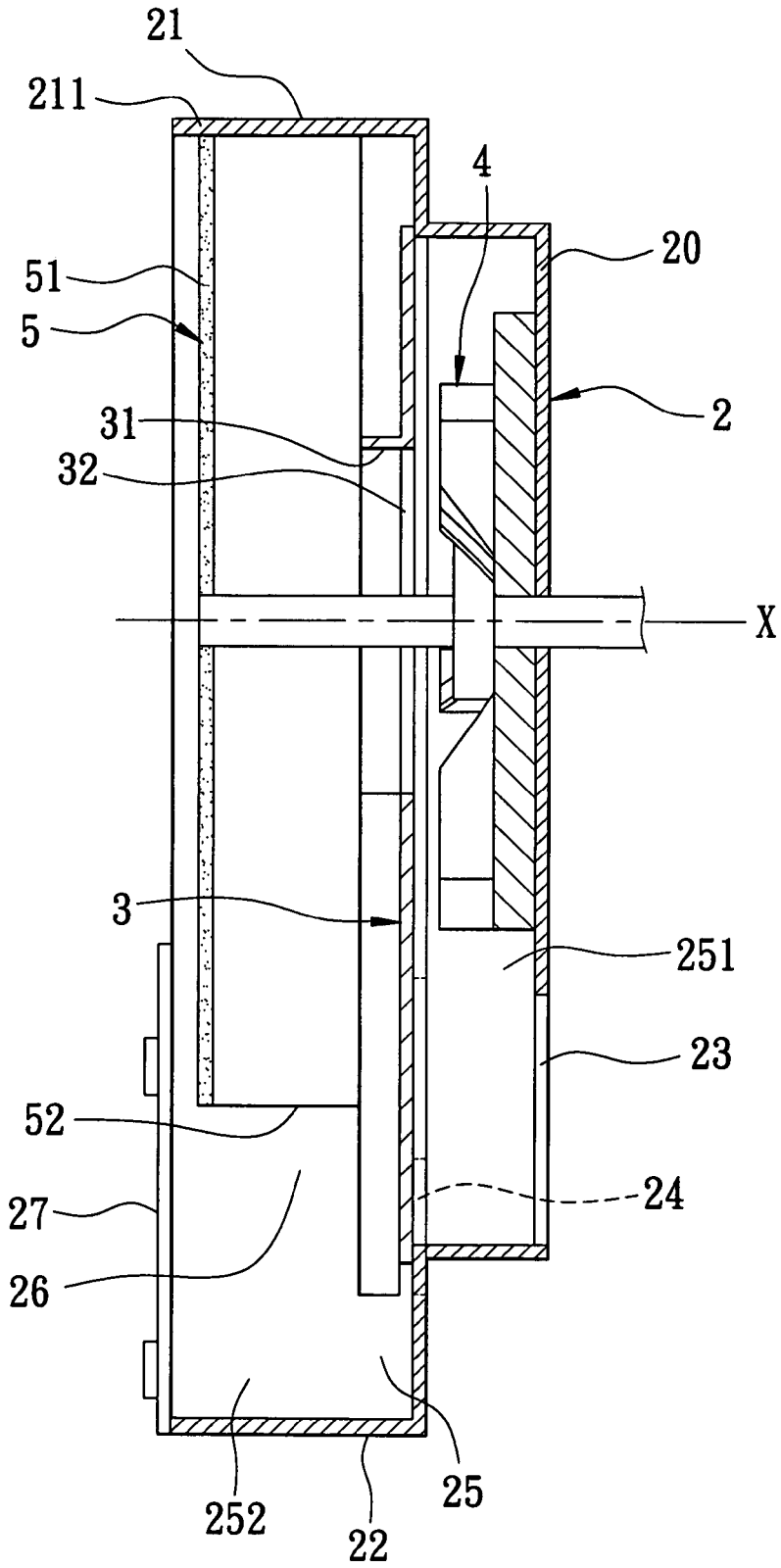
FIG. 5 is a sectional view of the grinding wheel and the dust collecting device shown in FIG. 4.
Figure 6:
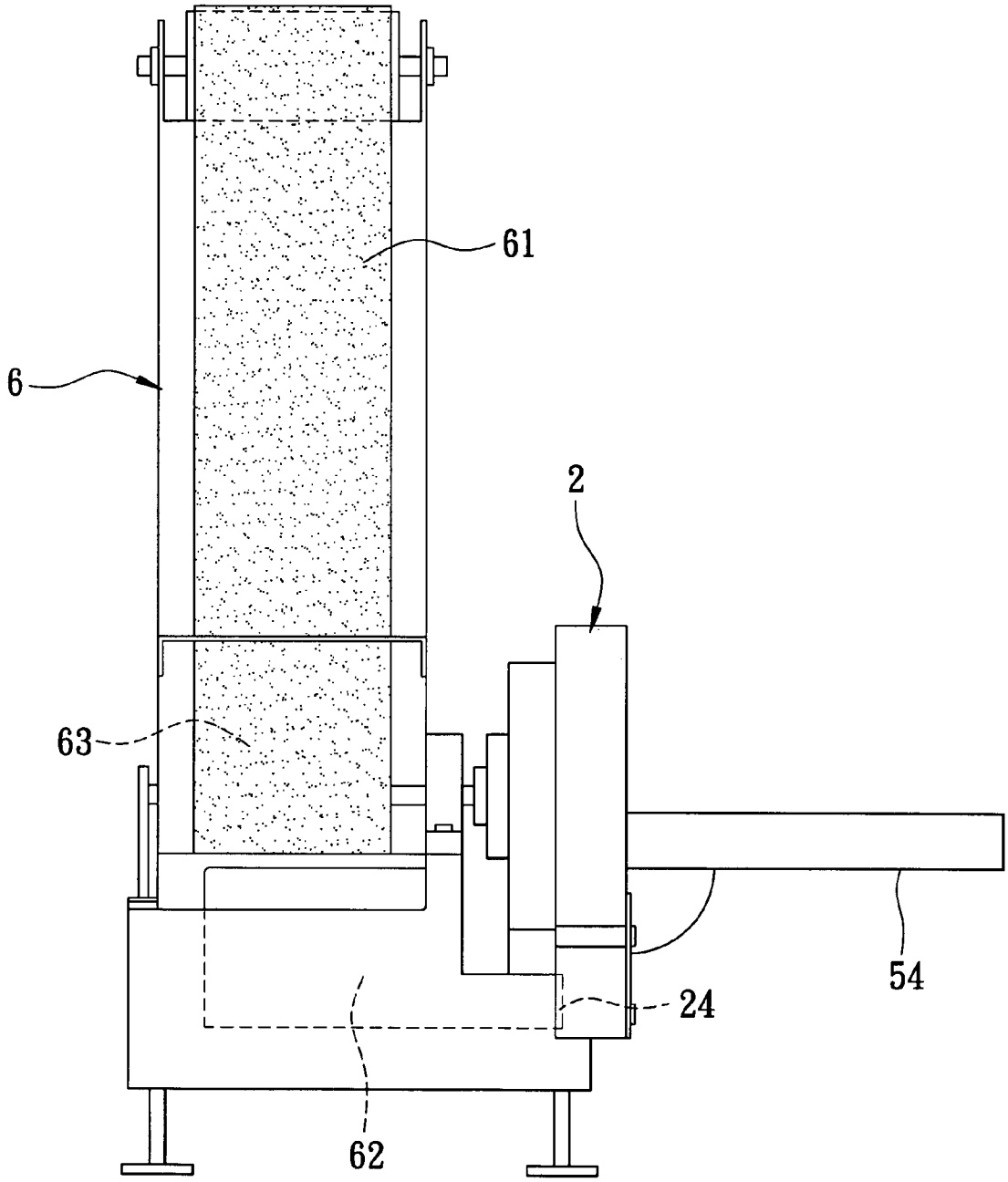
FIG. 6 is a schematic side view of the preferred embodiment.

Moreover, as shown in FIGS. 5 and 6, dust that is sent flying as a result of the sanding action of the emery coated belt 61 falls into the sanding dust collecting chamber 62, and is subsequently drawn into the impeller-side space 251 through the communicating port 24 and the air duct 32 for discharge through the dust discharge port 23.

Figure 3:
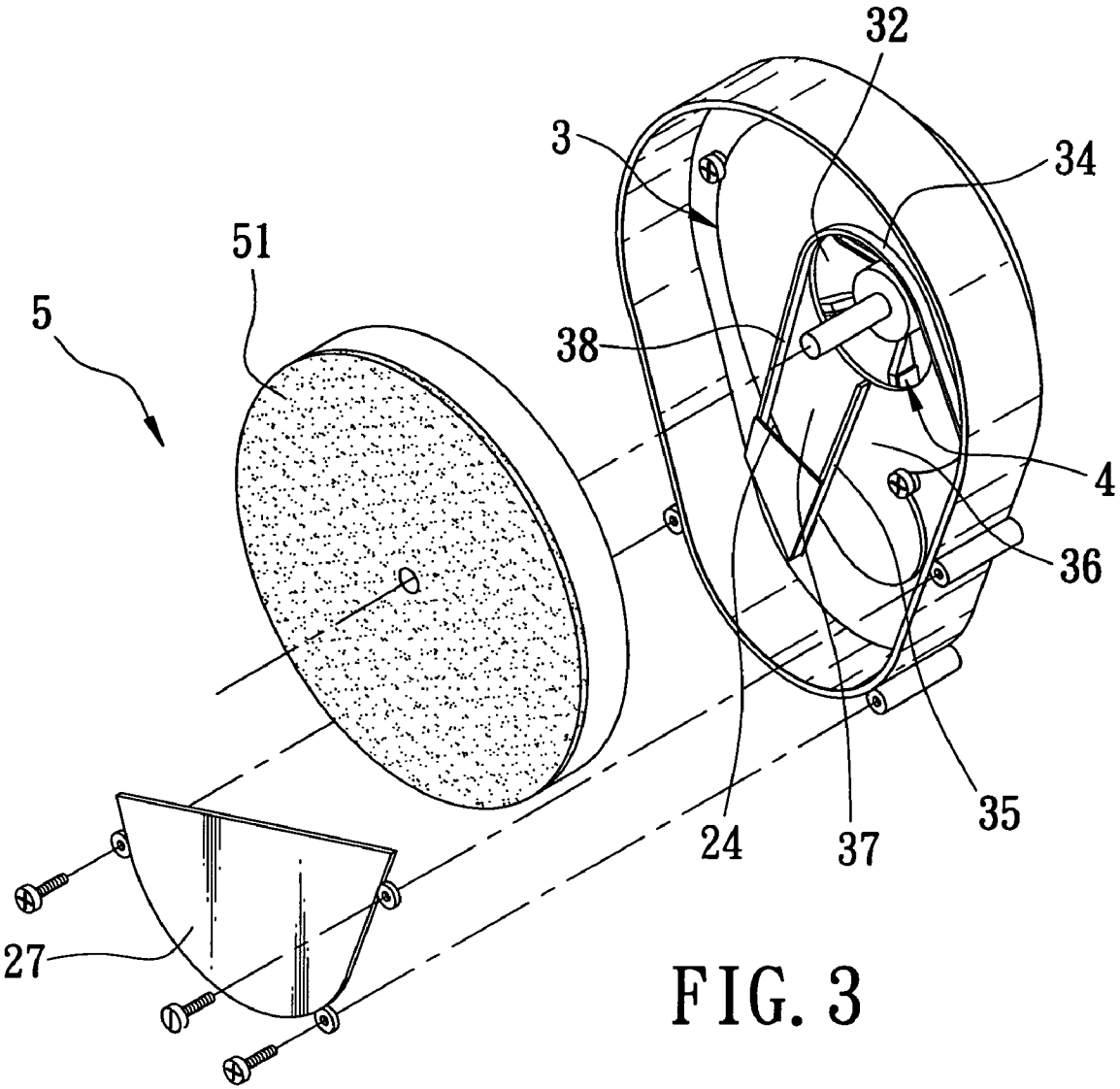
FIG. 3 is a partly exploded perspective view of the dust collecting device.
Figure 4:
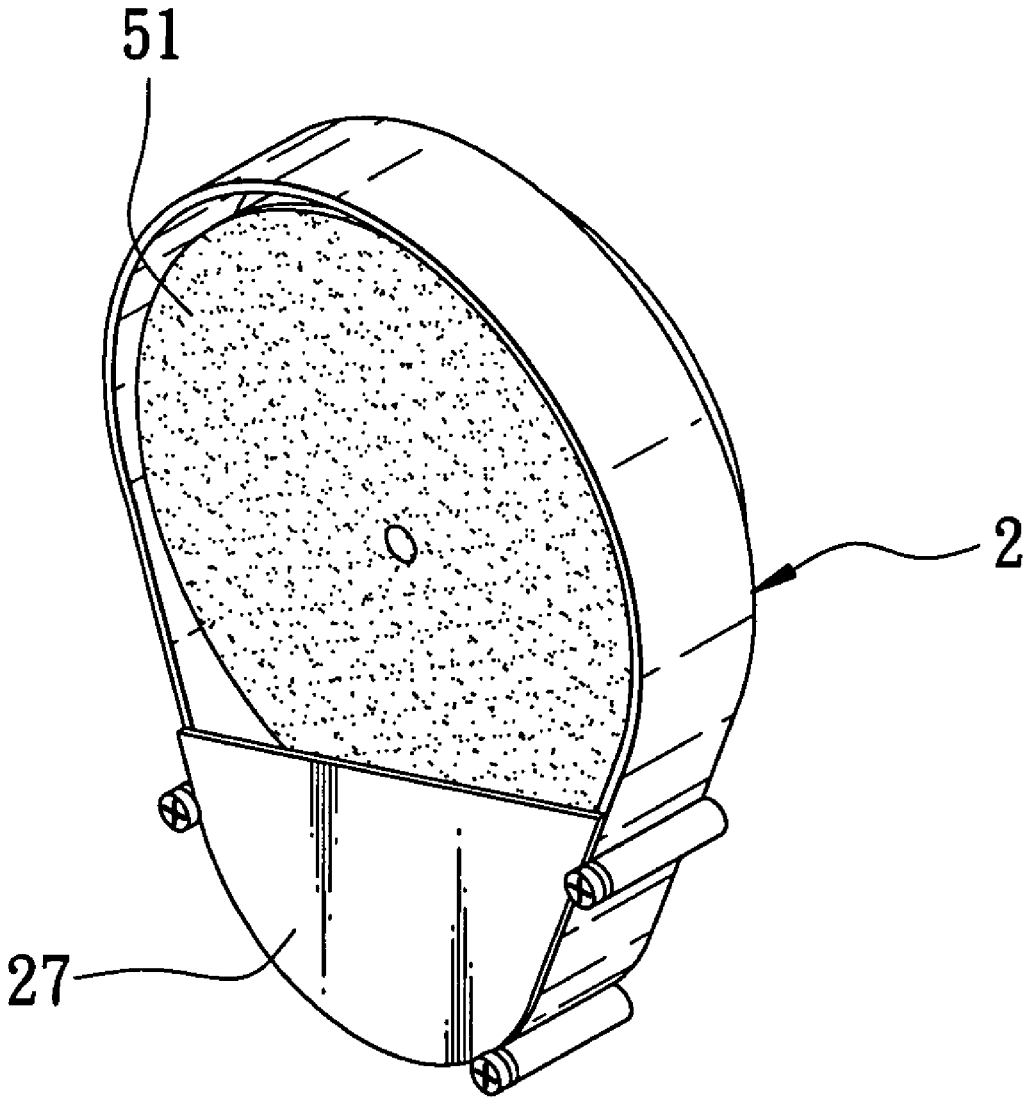
FIG. 4 is a perspective view showing the grinding wheel mounted in the dust collecting device.

Further, as shown in FIGS. 2, 3 and 5, the blower casing 21 further includes a first barrier flange 34 which is disposed in the grinding wheel-side space 252, which extends from the partition wall 3 in the longitudinal direction, and which has an arcuate segment 341 that extends along an upper portion of the inner peripheral edge 31, and a tangential segment 342 that extends outwardly from the arcuate segment 341 in a tangential direction relative to the axis (X), and a second barrier flange 35 which is disposed in the grinding wheel-side space 252, which extends from the partition wall 3 in the longitudinal direction, and which extends from a lower portion of the inner peripheral edge 31 to diverge from the tangential segment 342 so as to cooperate with the first barrier flange 34 to define a first dust gathering channel 36 therebetween. Thus, the air stream generated by virtue of the rotation of the impeller 4 is guided toward the air duct 32 so as to facilitate flowing of the dust entrained therein from the intake passage 26 to the first dust gathering channel 36.

The blower casing 21 further includes a third barrier flange 38 which is disposed in the grinding wheel-side space 252, and which extends from the partition wall 3 in the longitudinal direction. The third barrier flange 38 extends outwardly from the arcuate segment 341 of the first barrier flange 34 in a tangential direction relative to the axis (X), and cooperates with the second barrier flange 35 to define a second dust gathering channel 37 that is disposed downstream of the communicating port 24 for guiding the dust through the communicating port 24 into the air duct 32.

As illustrated, dust generated as a result of the grinding and sanding actions of the grinding wheel 5 and the sanding member 6 can be drawn by means of the same impeller 4, and can be discharged through the same dust discharge port 23, thereby resulting in convenient disposal of the collected dust and thereby rendering the size of the grinding machine compact. In addition, the impeller 4 is coaxially coupled with the grinding wheel 5 and the driven wheel 63 of the sanding member 6 so as to be driven by the same drive 10. Hence, an additional power unit is not required. Moreover, the arrangement of the first and second dust gathering channels 36, 37 helps guide dust from the grinding wheel 5 and the sanding member 6 to the dust discharge port 23.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A grinding machine comprising:

a drive with an output shaft;

a support frame disposed for mounting said drive so as to permit said output shaft to deliver a drive force;

an abrasive element which is rotatably mounted on said support frame and which is coupled to said drive to be driven by the drive force to rotate about an axis in a longitudinal direction, said abrasive element having a major wall which extends outwardly and in radial directions relative to the axis to terminate at a rim so as to form an abrasive surface thereon;

a blower casing including a proximate wall with a periphery, which is disposed on said support frame and which is opposite to said major wall of said abrasive element in the longitudinal direction, and a surrounding wall which extends from said periphery of said proximate wall in the longitudinal direction to confine a blower chamber and which extends beyond said rim of said abrasive element to terminate at an outer surrounding edge such that said surrounding wall is spaced radially apart from said rim to define a surrounding intake passage therebetween;

a dust discharge port which is disposed downstream of said intake passage, which is communicated with said blower chamber, and which is offset from the axis; and an impeller which is disposed in said blower chamber and which is coaxial with said abrasive element to be rotatable about the axis such that dust generated as a result of a grinding operation of said abrasive element is entrained in an air stream drawn into said blower chamber through said surrounding intake passage and subsequently out of said discharge port by virtue of rotation of said impeller;

said blower casing further including a partition wall which is disposed between said abrasive element and said impeller and which is disposed upstream of said dust discharge port and downstream of said intake passage so as to divide said blower chamber into an impeller-side space and a grinding wheel-side space, said partition wall having an inner peripheral edge which defines an air duct therein and which surrounds the axis so as to guide the dust-entraining air stream into said impeller-side space for discharge through said dust discharge port, a first barrier flange which is disposed in said grinding wheel-side space, which extends from said partition wall in the longitudinal direction, and which has an arcuate segment that extends along an upper portion of said inner peripheral edge, and a tangential segment that extends outwardly from said arcuate segment in a tangential direction relative to the axis, and a second barrier flange which is disposed in said grinding wheel-side space, which extends from said partition wall in the longitudinal direction, and which extends from a lower portion of said inner peripheral edge to diverge from said tangential segment so as to cooperate with said first barrier flange to define a first dust gathering channel therebetween such that the air stream generated by virtue of the rotation of said impeller is guided toward said air duct so as to facilitate flowing of the dust entrained thereinto from said surrounding intake passage to said first dust gathering channel.

2. The grinding machine of claim 1, wherein said dust discharge port is formed in and extends through said proximate wall in the longitudinal direction, said dust discharge port being disposed below said impeller so as to facilitate discharge of dust therethrough.

3. The grinding machine of claim 1, further comprising a sanding member which is disposed on said support frame, which is opposite to said abrasive element in the longitudinal direction, and which has a driven wheel that is coaxial with said impeller and said abrasive element to be rotatable about the axis, and an emery coated belt that is trained on and that is driven by said driven wheel for sanding a workpiece.

4. The grinding machine of claim 3, wherein said support frame defines a sanding dust collecting chamber disposed in a vicinity of said driven wheel to collect dust that is sent flying as a result of the sanding action of said emery coated belt, and a communicating port which is disposed to communicate said sanding dust collecting chamber with said blower chamber.

5. The grinding machine of claim 4, wherein said blower casing further includes a third barrier flange which is disposed in said grinding wheel-side space, and which extends from said partition wall in the longitudinal direction, said third barrier flange extending outwardly from said arcuate segment in a tangential direction relative to the axis, and cooperating with said second barrier flange to define a second dust gathering channel that is disposed downstream of said communicating port for guiding the dust from said communicating port into said air duct.

* * * * *